US006361107B1

(12) United States Patent
Alexander

(10) Patent No.: US 6,361,107 B1
(45) Date of Patent: Mar. 26, 2002

(54) CONTINUOUSLY ADJUSTABLE LAWN FURNITURE

(76) Inventor: John G. Alexander, 4303 Ingham Ave., Columbus, OH (US) 43214

( * ) Notice: Subject to any disclaimer, the term of this patent is extended or adjusted under 35 U.S.C. 154(b) by 0 days.

(21) Appl. No.: 09/589,182

(22) Filed: Jun. 3, 2000

Related U.S. Application Data

(60) Provisional application No. 60/137,318, filed on Jun. 3, 1999.

(51) Int. Cl.[7] ..... A47C 4/16

(52) U.S. Cl. ..... 297/56; 297/19; 297/463.1; 108/144.11; 248/188.2; 248/188.5

(58) Field of Search ..... 297/19, 56, 325, 297/344.18, 463.1; 248/188.2, 188.5; 108/1, 144.11, 147.19

(56) References Cited

U.S. PATENT DOCUMENTS 282,182 A * 7/1883 Flammang ..... 248/189.5
1,873,768 A 8/1932 Kux
2,282,109 A 5/1942 Angell
2,662,680 A * 12/1953 Bronson ..... 248/188.5
3,195,848 A 7/1965 Miller et al.
4,772,068 A * 9/1988 Gleckler et al. ..... 297/325
5,060,896 A * 10/1991 Hobbins ..... 297/344.18
5,244,249 A 9/1993 Tseng ..... 297/58
5,494,333 A 2/1996 Wilson ..... 297/344.18
5,746,152 A 5/1998 Huse ..... 297/344.18
5,848,822 A 12/1998 Wu ..... 297/344.18
5,882,068 A 3/1999 Levine ..... 297/21
6,030,148 A * 3/2000 Shank ..... 248/188.2

* cited by examiner

*Primary Examiner*—Peter R. Brown
(74) *Attorney, Agent, or Firm*—James R. Eley, Esq.; Jason D. Eisenberg, Esq.; Thompson Hine LLP

(57) ABSTRACT

Sturdy and easily adjustable lawn furniture provides for use on sloped surfaces ranging from zero to thirty degrees. Provisions are made so that adjustment of the furniture made be effected while in use. Additional features include a drink holder and a holder for printed materials.

6 Claims, 3 Drawing Sheets

CONTINUOUSLY ADJUSTABLE LAWN FURNITURE

This application claims the benefit of U.S. Provisional Application No. 60/137,318, filed Jun. 3, 1999.

BACKGROUND OF INVENTION

This invention relates to rugged, yet lightweight, outdoor furniture that is continuously adjustable to accommodate being employed on varying terrain.

Attendees of outdoor spectator events, such as golf, baseball, soccer, fireworks displays and parades, for example, typically use lawn furniture for seating during the event. Seating is commonly placed on nearby grass areas which may or may not be flat. A broad range of portable, folding and compact outdoor furniture is available in today's market but their designs are optimized for level or horizontal surfaces. The furniture is not the problem, rather it is the way the furniture is ill-suited to be used on sloping ground.

Depending on the angle of the ground or slope, the seat of most chairs remains roughly parallel (actually around 6°) relative to the ground upon which it is situated. As the slope of the ground increases, the angle of an individual's seated position relative to horizontal decreases. As the seating angle approaches zero and becomes negative, the seated individual's constant attempt to brace himself to keep from sliding out of the chair or to keep the chair from toppling forward does not create a situation of relaxed comfort, the goal of sitting in a chair in the first place. At some point of discomfort individuals, having nothing more than a fixed-leg lawn chair, may completely abandon the chair and elect to sit on the ground or try to find flatter ground for their chairs rather than fight the slope. Unfortunately, flatter ground simply may not exist, may be occupied by others or may offer an inferior viewing perspective of the event being observed.

In order to compensate for various grades or slopes, the legs of a chair should be easily and continuously adjustable to adapt to a wide degree of slopes in order to maintain a somewhat normal and comfortable seating angle. In addition, since the configuration and appearance of a portable chair may be subject to rules and restrictions at certain spectator events, a chair's capacity to adapt to sloping terrain seating may be subject to certain other physical limitations. For example, the current rules governing portable seating at the Memorial Golf Tournament held at the Muirfield Village Golf Club in Dublin, Ohio prohibit, among other things, chairs with arms and chairs over a certain height.

Attempts to solve this seating problem have resulted in several patents being granted patents for adjustable portable chairs. However, as will be evident from the discourse below, each of these attempts have shortcomings which have prevented them from fully achieving a solution to the slope problem.

U.S. Pat. No. 4,772,068, issued to Gleckler et al., discloses a portable folding chair intended for use on sloping terrain by fisherman and campers. Glecker et al.'s chair employs an adjustable extension which is limited to three fixed positions, which accommodates three different degrees of slope. The chair is not easily adjustable from the multiple, fixed seated positions and appears relatively complicated. In addition, the chair has arms which would prevent it from being used at certain events.

U.S. Pat. No. 5,494,333, issued to Wilson, discloses a chair which provides either three or four individually adjustable legs such that the chair can be used on a variety of terrain. Like Gleckler et al. the number of positions is fixed and thus cannot conform continuously to a wide degree of slopes. The legs do not appear to be easily adjustable by a user from a seated position. Like the Glecker chair, the Wilson chair has arms and thus would not conform to events accepting only portable chairs without arms.

U.S. Pat. No. 5,522,642, issued to Herzog, discloses a folding stool, with individually adjustable legs, that is adaptable for use on various sloped terrains. However, like the other chairs in the cited patents, the legs are not adjustable from a seated position and adjustment is limited to fixed number of angles based upon predetermined, fixed hole spacings. While Herzog has no arms, its ability of increasing the height of the stool for better viewing over crowds would violate chair policies for events regulating maximum allowable seat height for portable seating.

What is needed is sturdy, portable lawn furniture that is easily and quickly adjustable to accommodate varying slopes of terrain.

SUMMARY OF THE INVENTION

The present invention provides sturdy, portable lawn furniture that is easily and quickly adjustable to accommodate varying slopes of terrain. The furniture is provided with embodiments that can be used as either chairs or tables, depending upon whether the structure is provided with a back rest.

The disclosed invention provides numerous features and advantages over the prior art in a number of embodiments including:

- A chair for maintaining a normal seated position on flat, horizontal ground continuously up to thirty degree grades or slopes by utilizing a quick and sturdy rear leg leveling adjustment,
- A chair that is adjustable from a seated position,
- Solid construction, high quality materials, light-weight and portable,
- A portable chair that folds flat for storage and easy portage,
- A portable chair designed within specified limitations on chair seat height and width and chair back height for select events prohibiting certain chairs, i.e., lawn chairs, solid chairs and chairs with arms,
- Suitability for commercial and rental applications with sleek look, durability, function and design,
- Ability to be used on flat or horizontal ground in addition to sloped terrain,
- An integral beverage holder that swivels from its stored position to accept a standard, tapered, paper or plastic cup,
- A front slot for captively retaining a card, such as a golf pairing sheet or course description, wedding program, event program, etc.,
- Portible furninture that can be provided with or without a back support, in which case, it can be employed as a stool or a table that is also readily adaptable for use on sloped terrain.

These and other features, aspects, and advantages of the present invention will become better understood with regard to the following description, appended claims, and accompanying drawings.

DETAILED DESCRIPTION OF DRAWINGS

DETAILED DESCRIPTION OF THE INVENTION

Figure 2:
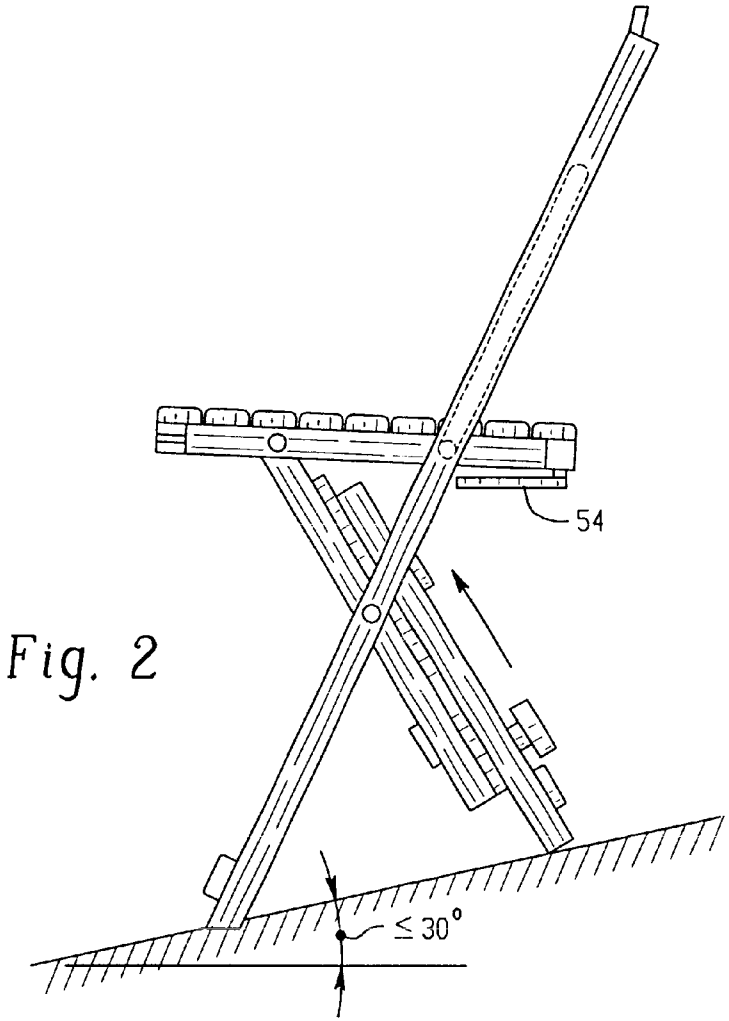
FIG. 2 is a side elevational view of one embodiment of the claimed invention adjusted to accommodate a sloped terrain of 30 degrees.
Figure 1:
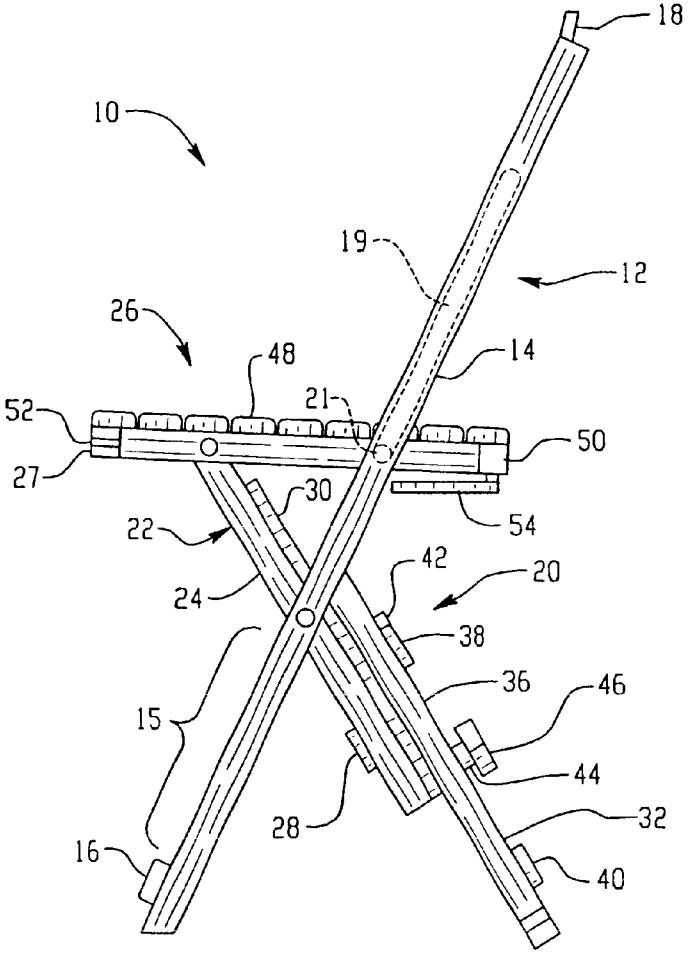
FIG. 1 is a side elevational view of one embodiment of the claimed invention detected on level ground.

Referring to the Figures, a chair 10 incorporating the present invention is there shown employed on level ground. Front leg assembly 12 consists of two parallel and symmetrical side members 14, 14', extending the entire height length of chair 10, permanently connected together at the bottom by a horizontal cross brace 16 and at the top by a horizontal back support 18. Lower horizontal cross brace 16 is preferably fixed nominally one inch above the lower extent of side members 14, 14' (also referred to as front legs 15, 15') in order to provide structural stability, a solid foot rest and to limit the amount the front legs penetrate soft ground. Upper horizontal back support 18, located between side members 14, 14' at their upper extents, further strengthens and stabilizes the front leg assembly 12 and provides sufficient back support to a seated user in the embodiment of the invention having a back.

Figure 4:
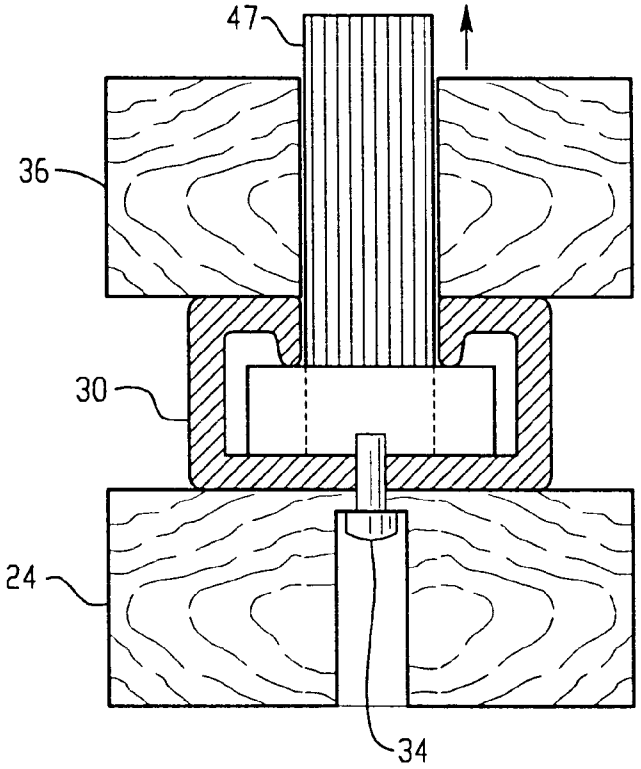
FIG. 4 is a cross-section of the slotted channel being engaged by an engaging bolt.
Figure 3:
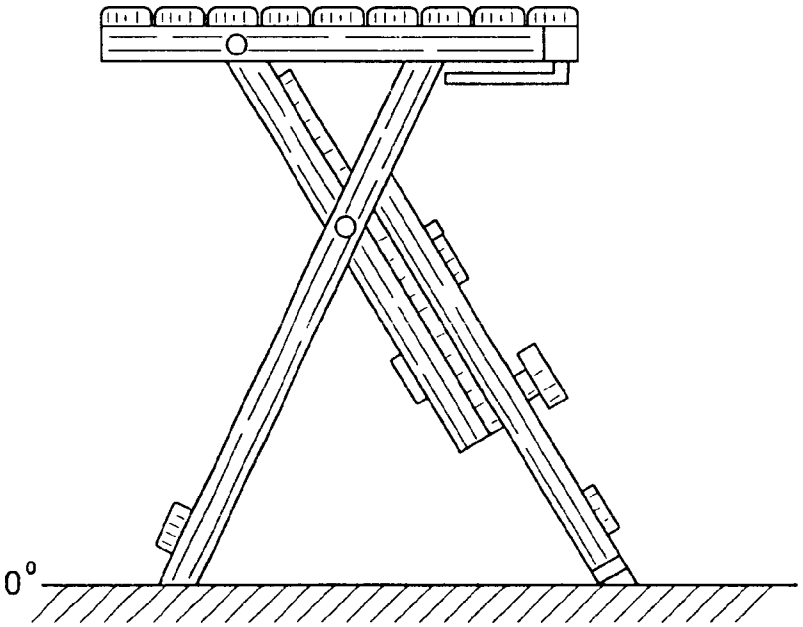
FIG. 3 is a side elevational view of one embodiment of the invention depicting a backless chair or table.
Figure 5:
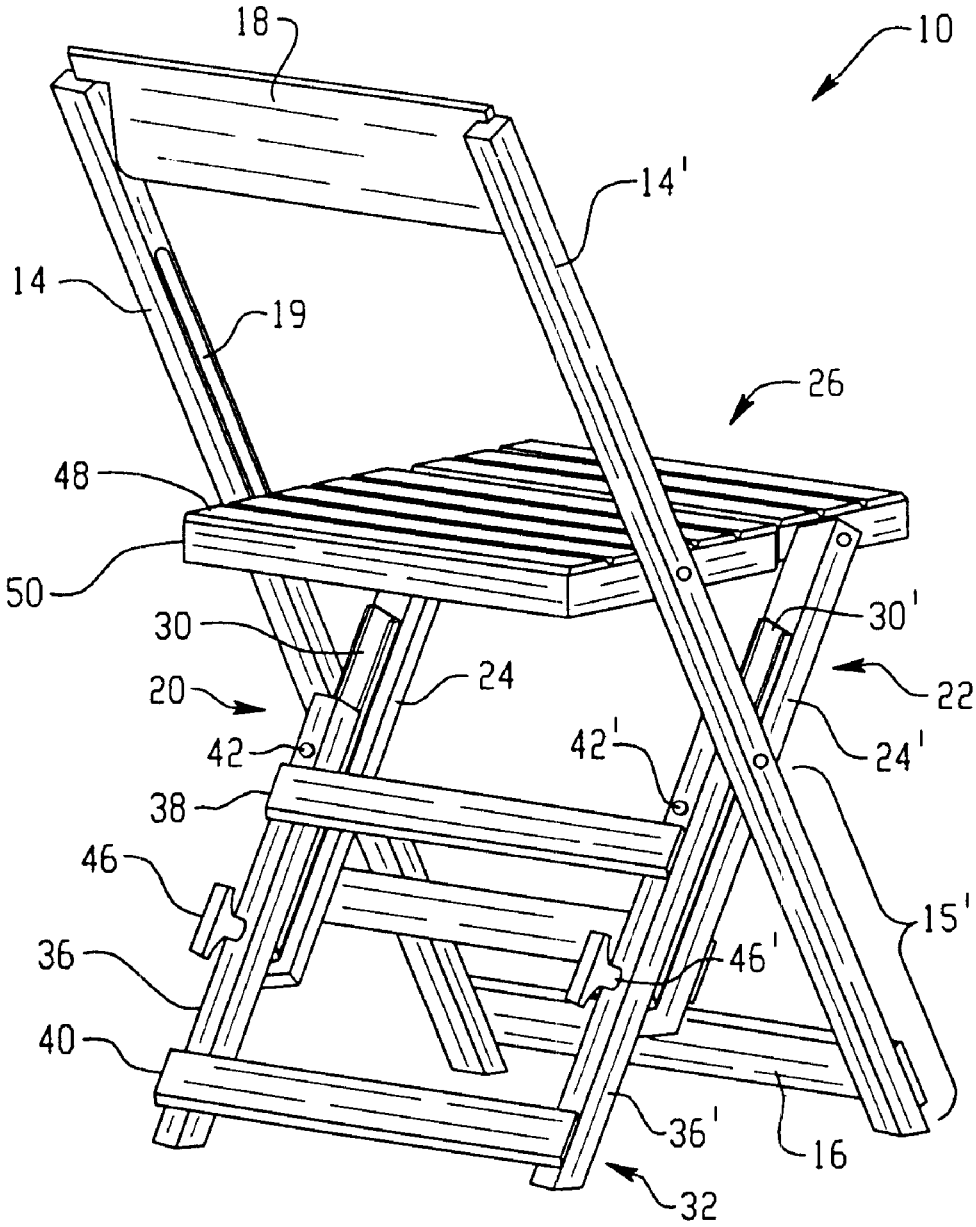
FIG. 5 is a rear perspective view of one embodiment of the invention.

The rear leg assembly 20 consists of two separate assemblies 22 and 32. The upper or forward rear assembly 22 comprises two symmetrical and parallel vertical members 24, 24' pivotally fixed adjacent to both the front leg assembly 12 and the seat body 26. To provide stability, cross brace 28 is fixed horizontally near the lower extent of and between forward rear assembly leg members 24, 24'. Attached to the rear facing sides of each member of fixed forward rear assembly 22 is a slotted channel 30, 30' sized to accept the continuously adjustable lower rear assembly 32. Channels 30, 30' may be provided as commercially available by UNISTRUT®. Referring additionally to FIG. 4, stop pins, such as dipicted at 34, are attached near the lower extent of each of the channels 30, 31' to prevent the lower rear leg assembly 32 from completely disengaging the channels during adjustment. The location of stop pin 34 provides a user with a chair having a seat 26 at a nominal 6 degrees above horizontal.

Lower rear assembly 32 comprises two symmetrical and parallel vertical leg members 36, 36' permanently connected by upper and lower horizontal cross braces 38, 40. Lower cross brace 40 is located nominally one inch above the lower extent of the leg members 36, 36' to provide stability and to limit the amount the leg members penetrate soft ground. In addition, each rear leg member 36, 36' has a fixed bolt 42, 42' secured with a locknut 44, 44' near the top and an engaging bolt 47, 47' secured with two-inch knobs 46, 46' near the bottom to engage the upper rear assembly 22 and provide continuously variable and easy adjustment of the angle of the chair 10. Engaging bolts 47, 47' may be provided with either a round, square or hexagonal type heads.

Seat body 26 comprises numerous slats, as at 48, preferably evenly spaced and fixed to seat frame 50. The front sides of the seat body 26 are pivotally attached near the top of the upper rear legs 36, 36'. The rear portion of seat body 26 is wider than the front portion of the seat in order to slide within longitudinal channels, as at 19 and 19', routed or otherwise located along the inside faces of the front leg assembly 12. Channels 19 and 19' receive a guide pins 21, 21' located near the rear on each side of the seat body 26. This configuration enables the chair 10 to be folded in a relatively flat plane for easy storage and also provides a stop point for the seat body 26 when unfolded. A through slot 52 is provide within the front horizontal face 27 of the seat body 26 to receive and captively retain flat, printed materials, such as score cards, golf pairing sheets, event programs, and the like. A flexible material (not shown), having a slot corresponding to through slot 52 is attached to the back face of the front side of seat frame 50, over through slot, to secure any materials inserted into the slot. On the side of seat 26, and preferably pivotally attached to its underside, is a drink holder 54 which may be constructed out of solid material, such as wood, plastic or metal with a hole that accommodates various sized beverage containers. When not in use, beverage holder 54 is rotated out of site and stored under seat body 26.

The chair 10 is sturdy having been weight tested up to 300 lbs. It may be constructed from metal, wood, composite materials or molded from a variety of plastics.

It is to be understood that while certain forms of the present invention have been illustrated and described herein, it is not to be limited to the specific forms or arrangements of parts described and shown.

I claim:

1. A portable and foldable chair for use on varying sloped surfaces ranging from zero degrees to thirty degrees comprising:

a front leg assembly having first and second parallel forward leg members each having an inside surface with a channel, said front leg assembly having a first horizontal brace located near a bottom extent of said leg members, and a second horizontal brace located near an upper extent of said leg members and forming a back support;

an upper rear leg assembly comprising two parallel rearward leg members pivotally attached near the upper extent of said rearward leg members to a front surface of a body of a seat, a third horizontal brace fixed near a bottom of the rearward leg members, and having c-shaped channels fixed to a back surface of said rear leg members to receive at least one engaging bolt;

a lower rear leg assembly engaged with said upper rear leg assembly and said engagement being performed by two parallel lower leg members each containing first and second fixed bolts, the first fixed bolt securing the engagement through use of a locknut and the second fixed bolt securing the engagement through use of an engaging bolt with a head extending into said c-shaped channels, the first and second fixed bolts operatively configured to fix said slidably engaged upper and lower rear leg assemblies in a determinable position, a fourth horizontal brace affixed near the upper extent of said lower rear leg members, and a fifth horizontal brace being affixed near the lower extent of the same; and the seat comprising a seat frame covered with slats, said seat being pivotally connected to the upper rear leg assembly at the front surface of the seat frame and having guides from side surfaces of said seat and engaged in said channels within the inside surface of said front leg assembly operatively configured to retain said seat in a flattened condition when said chair is folded into a stored condition.

2. The invention according to claim 1 further comprising a horizontal slot located in a front surface of said seat through which flat materials may be inserted and stored while said chair is being used.

3. The invention according to claim 1 wherein said seat stores a pivotable recepticle operatively configured to hold beverage containers when said recepticle is pivoted from said stored condition.

4. A portable table for use on varying sloped surfaces ranging from zero degrees to thirty degrees comprising:

a front leg assembly having first and second parallel forward leg members each having an inside surface with a channel, said front leg assembly having a first horizontal brace located near a bottom extent of said leg members, and a second horizontal brace located near an upper extent of said leg members;

an upper rear leg assembly comprising two parallel rearward leg members pivotally attached near the upper extent of said rearward leg members to a front surface of a body of a table top, a third horizontal brace fixed near a bottom of the rearward leg members, and having c-shaped channels fixed to a back surface of said rear leg members to receive at least one engaging bolt;

a lower rear leg assembly engaged with said upper rear leg assembly and said engagement being performed by two parallel lower leg members each containing first and second fixed bolts, the first fixed bolt securing the engagement through use of a locknut and the second fixed bolt securing the engagement through use of an engaging bolt with a head extending into said c-shaped channels, the first and second fixed bolts operatively configured to fix said slidably engaged upper and lower rear leg assemblies in a determinable position, a fourth horizontal brace affixed near the upper extent of said lower rear leg members, and a fifth horizontal brace being affixed near the lower extent of the same; and the table top comprising a table frame covered with slats.

5. The invention according to claim 4 further comprising a horizontal slot located in a front surface of said table top through which flat materials may be inserted and stored while said chair is being used.

6. The invention according to claim 4 wherein said table top stores a pivotable recepticle operatively configured to hold beverage containers when said recepticle is pivoted from said stored condition.

* * * * *